US010109949B2

(12) United States Patent
Spahi et al.

(10) Patent No.: US 10,109,949 B2
(45) Date of Patent: Oct. 23, 2018

(54) RADIALLY AND AXIALLY-COMPRESSED CERAMIC SEALING METHOD AND APPARATUS

(71) Applicant: Teledyne Instruments, Inc., Thousand Oaks, CA (US)

(72) Inventors: Sami Spahi, Winter Springs, FL (US); Justin Kretschmar, Port Orange, FL (US)

(73) Assignee: Teledyne Instruments, Inc., Thousand Oaks, CA (US)

( * ) Notice: Subject to any disclaimer, the term of this patent is extended or adjusted under 35 U.S.C. 154(b) by 191 days.

(21) Appl. No.: 14/980,106

(22) Filed: Dec. 28, 2015

(65) Prior Publication Data

US 2017/0187142 A1 Jun. 29, 2017

(51) Int. Cl.

| | |
|---|---|
| ***E21B 33/038*** | (2006.01) |
| ***E21B 17/02*** | (2006.01) |
| ***H01R 13/523*** | (2006.01) |
| ***H01R 13/52*** | (2006.01) |
| ***H01B 17/30*** | (2006.01) |
| *E21B 17/10* | (2006.01) |

(52) U.S. Cl.

CPC ..... *H01R 13/523* (2013.01); *E21B 33/0385* (2013.01); *E21B 17/1028* (2013.01); *H01B 17/305* (2013.01); *H01R 13/5219* (2013.01)

(58) Field of Classification Search

CPC . H01B 17/305; E21B 17/028; E21B 33/0385; H01R 13/5219; H01R 13/523

See application file for complete search history.

(56) References Cited

U.S. PATENT DOCUMENTS

| | | | | |
|---|---|---|---|---|
| 1,456,110 A | | 5/1923 | MacKay | |
| 2,503,194 A | | 4/1950 | Cipriani | |
| 2,942,135 A | | 6/1960 | McLaren | |
| 4,037,891 A | | 7/1977 | Walters | |
| 4,071,663 A | | 1/1978 | Bredbenner | |
| 4,251,680 A | * | 2/1981 | Germann | H01B 17/305 174/151 |
| 5,103,900 A | | 4/1992 | McLeod | |
| 7,959,454 B2 | * | 6/2011 | Ramasubramanian | H01R 13/03 439/201 |
| 8,303,312 B2 | * | 11/2012 | Raad | H01R 13/523 439/8 |
| 8,968,018 B2 | * | 3/2015 | Sivik | H02G 3/22 439/271 |

(Continued)

FOREIGN PATENT DOCUMENTS

WO WO 2015/107358 A2 7/2015

*Primary Examiner* — Nicholas L Foster

(74) *Attorney, Agent, or Firm* — Duncan Galloway Egan Greenwald, PLLC; Kevin T. Duncan

(57) ABSTRACT

The present invention provides a system and method for providing a seal for an electrical penetrator in a subsea environment. More specifically, the present invention provides for a system for creating a seal about an electrical penetrator without using o-rings or independent seals. The present invention provides for a set of supporting apparatuses to be placed in compression about a central ceramic penetrator element. The geometry of the central ceramic penetrator element and the interior of the supporting apparatuses forms a hermetic seal when under a constant radial and axial, or axial compressive force.

10 Claims, 5 Drawing Sheets

(56) References Cited

U.S. PATENT DOCUMENTS

| | | | | |
|---|---|---|---|---|
| 2011/0006518 | A1 | 1/2011 | Poulton | |
| 2011/0021049 | A1* | 1/2011 | Ramasubramanian | H01R 13/03 439/201 |
| 2011/0250774 | A1* | 10/2011 | Raad | H01R 13/523 439/271 |
| 2013/0183853 | A1* | 7/2013 | Sivik | H01R 13/523 439/519 |
| 2014/0109699 | A1 | 4/2014 | Janitch | |
| 2014/0360729 | A1 | 12/2014 | Benestad | |
| 2017/0175476 | A1* | 6/2017 | Painter | E21B 33/0385 |

* cited by examiner

RADIALLY AND AXIALLY-COMPRESSED CERAMIC SEALING METHOD AND APPARATUS

FIELD OF THE INVENTION

The present invention generally relates to an electrical power feedthrough. More specifically, the present invention relates to a sealing method and apparatus for an electrical penetrator in an electrical power feedthrough system in a subsea environment.

BACKGROUND

In subsea production, electrically operated apparatuses below sea level are typically supplied by power from sea- or land-based host facilities. The power is provided from the external sources to the subsea devices via cable conductors to submerged process control equipment, pumps and compressors, transformers, motors, and other electrically operated equipment. As these components are disposed subsea and are typically enclosed and protected by water-proof pressure vessels, power is provided by means of a cable termination and connector, which may be an electrical penetrator, designed to penetrate and provide power through a bulkhead.

In existing penetrator assemblies, the conductor pin of the penetrator is embedded in an insulator body, which may be seated in a penetrator housing and is sealed against the penetrator housing by means of O-rings, or other types of seals. In submerged applications the electrical penetrator must be protected from the ingress of water. At operational water depths down to and below 1,000 meters the penetrator and subsea device are both subjected to immense external pressure. This pressure requires a penetrator structure that is adapted to operate despite high external pressures and differential pressures over seals.

In one embodiment an electrical penetrator may be used to power subsea electric submersible pump (ESP) equipment and the like which pump hydrocarbons in oil well installations, and also in other applications such as high pressure downhole electrical penetrations and other penetrations to provide power to various types of subsea equipment. The penetrator extends through the wall or bulkhead of the vessel in which the equipment is located, and is normally connected to power cables at one end for connecting the equipment to an external power source. In an ESP application, the connection or penetrator cannot be isolated from the pumping pressure for practical reasons. This creates an extreme environment for the connector or penetrator in terms of pressure, temperature, and high voltage. The penetrator must transfer power to the motor as well as maintaining a pressure barrier for both internal pressure created by the ESP and external pressure caused by the depth in seawater. The temperatures are increased due to fluid temperatures as well as resistive heating of the electrical elements. These penetrators must also be able to resist sustained intense heat from a hydrocarbon fire and maintain both electrical connectivity and seal integrity in high temperature and material stress situations.

In a typical electrical penetrator or feed through a set of seals and/or o-rings are used to prevent the ingress of external fluids into the subsea device and to prevent internal fluids from escaping. The seals must be qualified to show that they meet certain standards such as those set by the American Petroleum Institute ("API") for subsea oil and gas applications. Such standards may include API 6A and API

17D. Seals used with electrical penetrators may also be qualified to prove that they pass extended pressure and heat cycles, and "make or break" testing cycles where alternating pressures are applied to the seals. These qualification measures are expensive and time consuming. It may be difficult to find or design a seal suitable for a particular electrical penetrator.

Furthermore, seals such as those described above may need to be replaced or may fail. Problems also exist with the installation and replacement of these seals and o-rings. The seals or o-rings may become damaged, dislodged, or may shift in the seal housings. Any of these issues may cause a leak or seal failure, resulting in damaged equipment, production downtime, and lengthy and expensive repair and replacement procedures.

Existing systems, apparatuses, and methods for electrical penetrators and penetrator assemblies are known and are described in at least U.S. Pat. No. 8,287,295, entitled ELECTRICAL PENETRATOR ASSEMBLY (Sivik et al.), and U.S. Pat. No. 8,968,018, entitled ELECTRICAL PENETRATOR ASSEMBLY (Sivik et al.), each of which are incorporated by reference herein in their entirety.

What is needed is a sealing method for an electrical penetrator or set of electrical penetrators that does not require a set of o-rings or seals and that can provide a hermetic seal under extreme pressures and temperatures in a subsea environment.

SUMMARY OF THE INVENTION

The sealing method and apparatus of the present invention are an unexpected result from the design, testing, and qualification of traditional sealing elements. The present invention provides a ceramic penetrator sealing method and apparatus that does not require additional o-rings or seals. The present invention creates a hermetic seal by applying radial and axial forces to a metallic supporting apparatus compressed onto ceramic core. Utilizing high axial or radial compressive forces on a ceramic component forms a hermetic seal without the necessity of o-rings or additional metal or elastomeric seals. The metal supporting apparatus and ceramic core may be installed into a pressure containing apparatus to form a high pressure seal. The unique loading of forces (axial and radial, or axial compression), allow the present invention to withstand high pressures from multiple directions. The geometry at which the ceramic and metal interface at a certain constant pressure load form the hermetic seal. It was discovered that when applying sufficient foot-pound torquing force to a nut/bolt pair that a substantial compressive force or clamping force was generated such that the axial and/or radial forces exerted on the ceramic core by the metallic fixture or supporting apparatus creating a hermetic seal about a shoulder on the ceramic core. The angled, raised shoulders are critical to forming the hermetic seal. The ceramic core may be surrounded by a metallic sleeve. The hermetic seal may be formed about the angled shoulders with an intermediate metallic sleeve between the ceramic core and fixture, or may be formed without the metallic sleeve. The amount of force required to form the seal is not dependent on the external surroundings or conditions including external pressure conditions.

In one embodiment, a ceramic cylindrical core is disposed into a formed slot in a metallic supporting apparatus, the slot having machined dimensions to fit the exterior geometry of the ceramic core. A set of top and bottom metallic plates are installed at both ends of the ceramic core and compressed together with high compressive forces. The compressive forces on the opposite facing metallic plates apply compressive forces on the ceramic shoulders of the core. These compressive forces act on the ceramic core and the metallic supporting apparatus with very specific geometry, inducing both an axial and radial load on the ceramic core, metallic supporting apparatus, and metallic plates. The present invention solves the problem of sealing off gas and liquid mediums from infiltrating between ceramic and metallic substrates. The sealing mechanism does not rely on known sealing methods including o-rings, metal seals, and over molds. The present invention uses a combination of geometries and compressive force on ceramic and metal faces, which are placed in compression against each other, to create a high reliability seal. The seal provided by the system and method of the present invention requires a ceramic core in contact with a metallic supporting apparatus with a specific amount of compression applied in both axial and radial, or axial directions. The sealing apparatus of the present invention is not a separate element or component, but is the result of bringing materials, which may in one embodiment be ceramic-to-metal interface, together under pressure and compression at a favorable geometric interface.

In a first embodiment, the present invention provides a sealing apparatus comprising: a central element having a first end and second end and being substantially cylindrical and having a raised central portion, the raised central portion having a first and second shoulder; a first fixture, the first fixture having a first and second side and having an opening adapted to fit around the first end of the central element and to surround and abut the first shoulder of the central element; a second fixture, the second fixture having a first and second side and having an opening adapted to fit around the second end of the central element and to surround and abut the second shoulder of the central element; wherein a set of forces are constantly applied to the first and second fixture to form a seal about the raised central portion of the central element.

The invention according to the first embodiment may further comprise a third fixture, the third fixture having a first side and a second side and being disposed at the second side of the second fixture. The apparatus may further comprise wherein the first fixture is further adapted to abut the front of the third fixture; and the second fixture further is adapted to abut the rear of the third fixture; wherein the set of forces applied to the first and second fixtures compress said first and second fixtures to the respective first and second shoulders of the central element and the front and back of the third fixture. The central element may comprise a ceramic material. The set of forces may be applied by, for example, a set of nuts and bolts and may be a 96,000 pound clamping force on the apparatus. For example, in the testing arrangement shown in FIGS. 3 and 4, each nut and bolt pair in the set of eight nut and bolt pairs may apply a 12,000 pound clamping force on the apparatus. The first and second shoulders may be angled from the central element at an angle of greater than 0° but less than 90° and the set of forces comprise both radial and axial compressive forces. The first and second shoulders may be angled from the central element at an angle of 90° and the set of forces comprise axial compressive forces.

In a second embodiment, the present invention provides a method for forming a seal around an element, the method comprising: applying a compressive force to a first sealing element and a second sealing element, the first and second sealing elements surrounding a central element, the central element having a raised central portion; wherein the first sealing element abuts a first shoulder of the raised central portion of the central element and the second sealing element abuts a second shoulder of the raised central portion of the central element forming a hermetic seal about first and second shoulders of the central element.

The method may further comprise, positioning a third sealing element about the exterior raised central portion of the central element, the third sealing element disposed between the first sealing element and the second sealing element. The compressive force may be applied to the first and second sealing elements compress said first and second sealing elements to the respective first and second shoulders of the central element and to the third sealing element. The central element may comprise a ceramic material. The compressive force may be applied by, for example, a set of nuts and bolts and may be a 96,000 pound clamping force. For example, each nut and bolt pair in the set of eight nut and bolt pairs may apply a 12,000 pound clamping force. The first and second shoulders may be angled from the central element at an angle of greater than 0° but less than 90° and the compressive force comprises both radial and axial compressive forces. The first and second shoulders may be angled from the central element at an angle of 90° and the compressive force comprises only axial compressive forces.

In another embodiment, the present invention provides a sealing apparatus for use in subsea environments exposed to demanding differential pressure conditions, the apparatus comprising: a central element having a first end and second end and being substantially cylindrical and having a raised central portion, the raised central portion being ceramic and having first and second shoulders; a first fixture having an opening adapted to receive the first end of the central element and a metallic seal surface geometrically configured to abut the first shoulder of the central element; a second fixture having an opening adapted to receive the second end of the central element and a metallic seal surface geometrically configured to abut the second shoulder of the central element; and a means for applying a set of forces to the first and second fixtures to form a seal about the raised central portion of the central element by urging the respective metallic seal surfaces into engagement with the respective first and second shoulders of the raised central portion, the set of forces collectively applying a minimum of 90,000 pound clamping force.

The apparatus may further comprise a third fixture, the third fixture having a first side and a second side and being disposed at the second side of the second fixture. The apparatus may further comprise wherein: the first fixture further adapted to abut the front of the third fixture; and the second fixture further adapted to abut the rear of the third fixture; wherein the set of forces applied to the first and second fixtures compress said first and second fixtures to the respective first and second shoulders of the central element and the front and back of the third fixture. The apparatus may further comprise wherein the central element comprises a ceramic material having a metallic sleeve disposed about the raised central portion. The apparatus may further comprise wherein the set of forces collectively apply a 96,000 pound clamping force. The apparatus may further comprise wherein the means for applying the set of forces comprises a set of nut and bolt pairs. The apparatus may further comprise wherein each nut and bolt pair in the set of nut and bolt pairs applies a 12,000 pound clamping force. The apparatus may further comprise wherein the first and second shoulders are angled from the central element at an angle of greater than 0° but less than 90° and the set of forces comprise both radial and axial compressive forces. The apparatus may further comprise wherein the first and second shoulders are angled from the central element at an angle of 90° and the set of forces are axial compressive forces. The apparatus may further comprise wherein the central element comprises a communications component having terminal ends that extend beyond the first and second fixtures. The apparatus may further comprise further comprising a means for preventing excessive set of forces being applied to the first and second fixtures. The apparatus may further comprise a means to prevent overtightening of the nuts of the nut and bolt pairs, or may alternatively comprise a means to limit tightening to a certain pre-defined specification.

In another embodiment, the present invention provides a method for forming a seal around a communications component disposed in high differential pressure undersea environment, the method comprising: applying a compressive force to a first sealing element and a second sealing element, the first and second sealing elements surrounding and abutting a raised central portion of the communications component; and wherein the first sealing element abuts a first shoulder of the raised central portion of the communications component and the second sealing element abuts a second shoulder of the raised central portion of the communications component thereby forming a hermetic seal about first and second shoulders of the central element.

The method may further comprise positioning a third sealing element about the exterior raised central portion of the communications component, the third sealing element disposed between the first sealing element and the second sealing element. The method may further comprise wherein the compressive force applied to the first and second sealing elements compress said first and second sealing elements to the respective first and second shoulders of the communications component and to the third sealing element. The method may further comprise wherein the raised central portion of the communications component comprises a ceramic material. The method may further comprise wherein the compressive force is applied by a set of nut and bolt pairs. The method may further comprise wherein the compressive force is a minimum 90,000 pound clamping force. The method may further comprise wherein each nut and bolt pair in an N-number of sets of nut and bolt pairs applies a minimum (1/N*90,000) pounds of clamping force. The method may further comprise wherein the first and second shoulders are angled from the central portion at an angle of greater than 0° but less than 90° and the compressive force comprises both radial and axial compressive forces. The method may further comprise wherein the first and second shoulders are angled from the central portion at an angle of 90° and the compressive force comprises only axial compressive forces.

In yet another embodiment, the present invention provides an electrical plug for use in undersea environments exposed to demanding differential pressure conditions, the plug comprising: a set of electrical penetrators, each electrical penetrator in the set of electrical penetrators comprising: a two piece substantially cylindrical body having a first and a second end, and having a first body portion and a second body portion, each of the first and second body portions comprising a ceramic insulator, a raised central portion, the raised central portion being ceramic and having first and second shoulders; a conductor disposed within the first and second body portions; a sealing sleeve joining the first and second body portions; and a set of metallic end sleeves disposed at the first and second ends of the cylindrical body, joining the conductor to the first and second body portions; wherein the conductor extends beyond the first and second ends of the two piece cylindrical body; a cable, the cable comprising a cable pigtail having a set of pigtail ends, each pigtail end in the set of pigtail ends being terminated at the conductor at the first end of an electrical penetrator in the set of electrical penetrators; a first fixture having an opening adapted to receive the first end of the central element and a metallic seal surface geometrically configured to abut the first shoulder of the central element; a second fixture having an opening adapted to receive the second end of the central element and a metallic seal surface geometrically configured to abut the second shoulder of the central element; a means for applying a set of forces to the first and second fixtures to form a seal about the raised central portion of the central element by urging the respective metallic seal surfaces into engagement with the respective first and second shoulders of the raised central portion, the set of forces collectively applying a minimum of 90,000 pound clamping force; and wherein the electrical plug is adapted to mate with an electrical receptacle.

BRIEF DESCRIPTION OF THE DRAWINGS

In order to facilitate a full understanding of the present invention, reference is now made to the accompanying drawings, in which like elements are referenced with like numerals. These drawings should not be construed as limiting the present invention, but are intended to be exemplary and for reference.

DETAILED DESCRIPTION

The present invention will now be described in more detail with reference to exemplary embodiments as shown in the accompanying drawings. While the present invention is described herein with reference to the exemplary embodiments, it should be understood that the present invention is not limited to such exemplary embodiments. Those possessing ordinary skill in the art and having access to the teachings herein will recognize additional implementations, modifications, and embodiments, as well as other applications for use of the invention, which are fully contemplated herein as within the scope of the present invention as disclosed and claimed herein, and with respect to which the present invention could be of significant utility.

Figure 1:
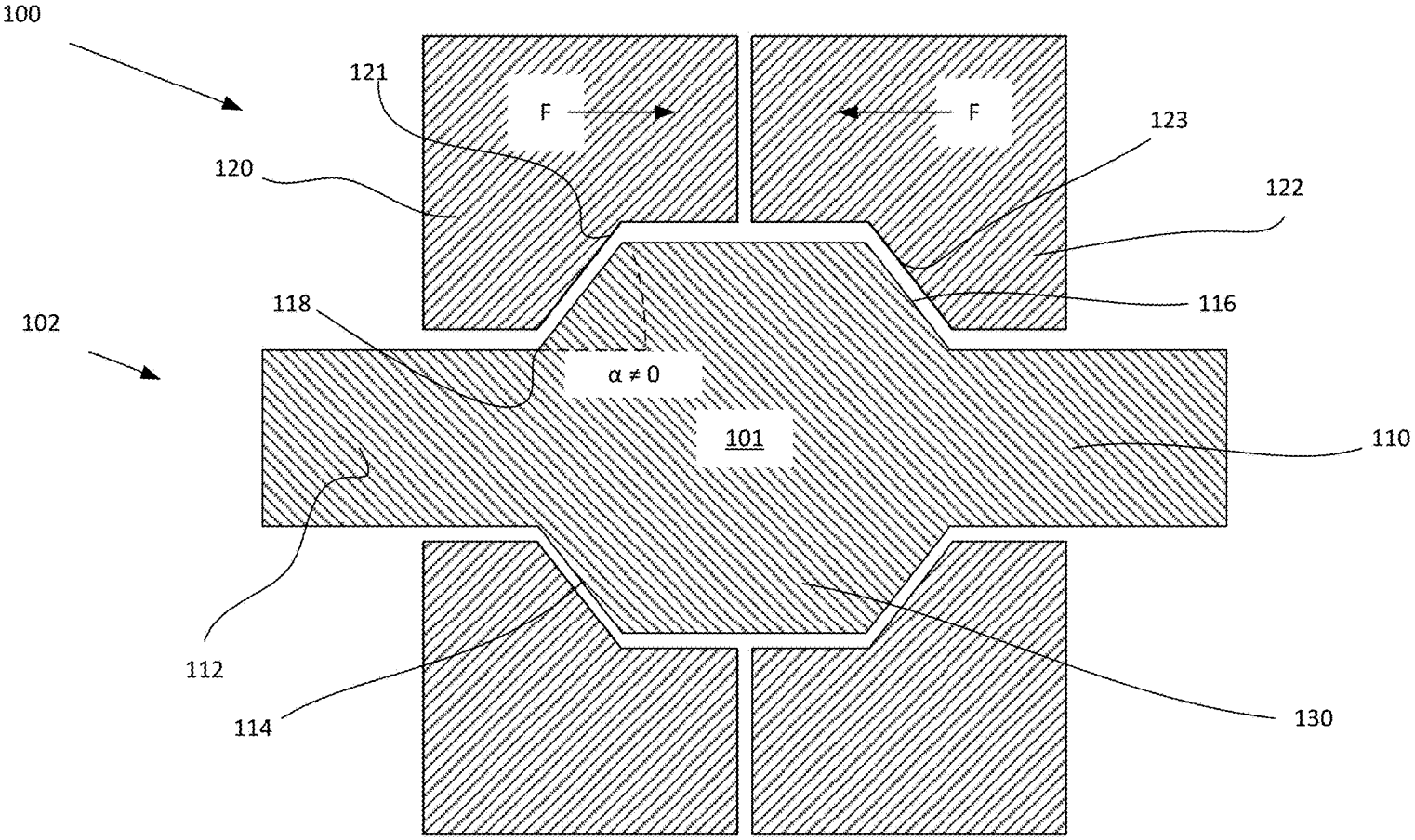
FIG. 1 provides a schematic cross-section of a first embodiment of a sealing apparatus wherein the shoulder angle on the ceramic core is less than 90 degrees in accordance with the present invention.

With reference to FIG. 1, a schematic cross-section of a first embodiment of a sealing apparatus 100 in accordance with the present invention is provided. The sealing apparatus 100 comprises a first fixture 120 and a second fixture 122 providing compressing forces F on the ceramic core 102.

The ceramic core 102 has a first end 112, a second end 110, and a raised central portion 130. The ceramic core 102 has body 101 that is substantially cylindrical and is adapted to be disposed within the interior of first fixture 120 and second fixture 122. The raised central portion 130 has a first shoulder 114 and a second shoulder 116. The first shoulder 114 is adapted to be in physical contact with the interior 121 of the first fixture 120 and the second shoulder 116 is adapted to be in physical contact with the interior 123 of the second fixture 122. The first 120 and second shoulder 122 provide a set of compressing forces F on the shoulders 114 and 116 of the raised central portion 130 of the ceramic core 102.

The forces F may comprise both radial and axial compressive forces based on the degree, a, of the angle 118. The degree a of the angle 118 must be greater than 0, and the shoulder angle 118 on the ceramic core 102 is less than 90 degrees. The geometry of the shoulders 114 and 116 of the raised central portion 130 and of the interiors 121 and 123 of the respective first 120 and second 122 fixtures with the compressive force F creates a heretic seal about the ceramic core 102 at the abutment of the shoulders 114 and 116 of the raised central portion 130 and of the interiors 121 and 123 of the respective first 120 and second 122 fixtures. The heretic seal is maintained through the constant application of a compressive force on the ceramic core 102 by the first 120 and second 122 fixtures.

Figure 2:
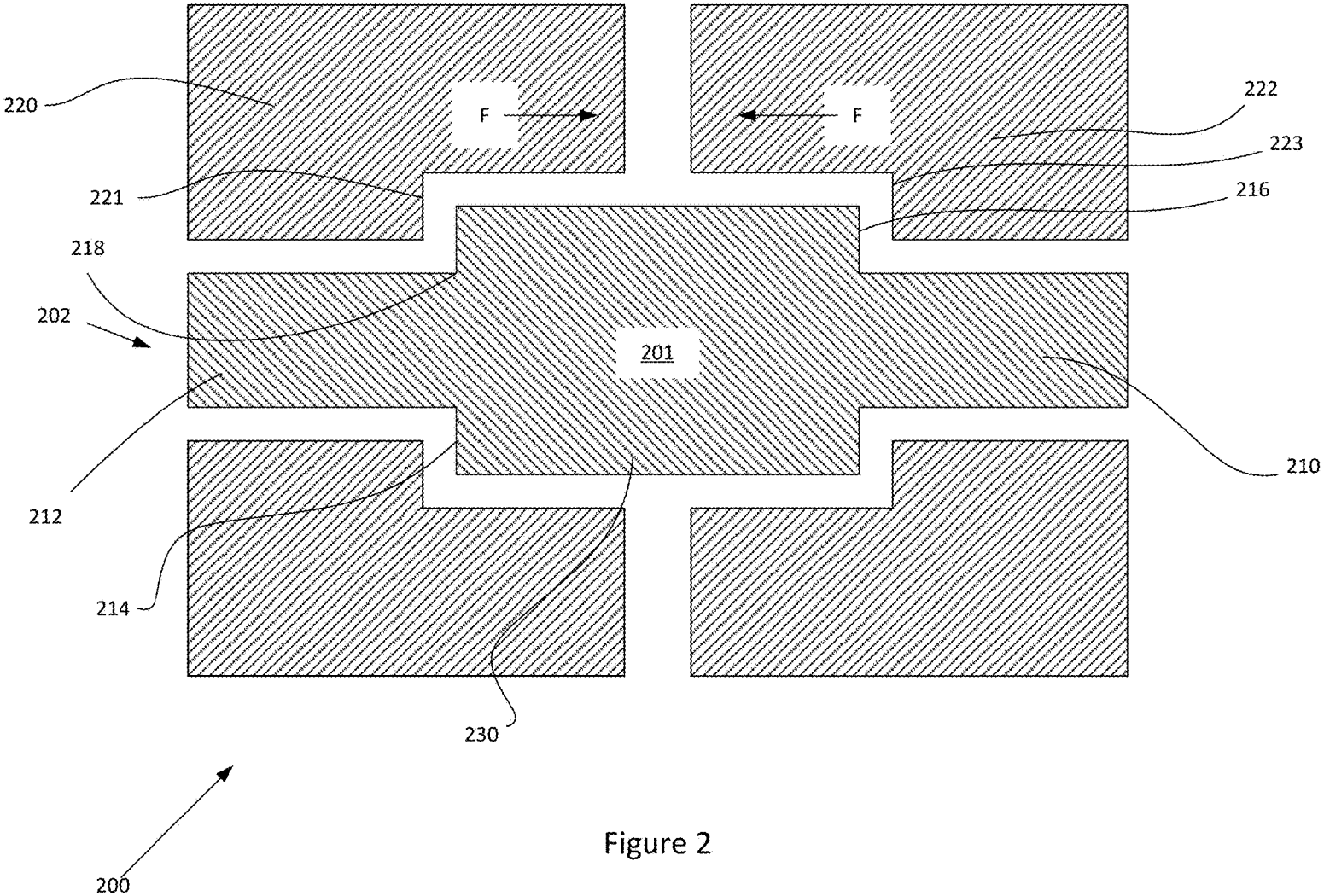
FIG. 2 provides a schematic cross section of a second embodiment of a sealing apparatus wherein the shoulder angle of the ceramic core is 90 degrees in accordance with the present invention.

With reference to FIG. 2, a schematic cross section of a second embodiment of a sealing apparatus 200 wherein the shoulder angle 218 of the ceramic core 202 is 90 degrees in accordance with the present invention is provided. The sealing apparatus 200 comprises a first fixture 220 and a second fixture 222 providing compressing forces F on the ceramic core 202. The ceramic core 202 has a first end 212, a second end 210, and a raised central portion 230. The ceramic core 202 has body 201 that is substantially cylindrical and is adapted to be disposed within the interior of first fixture 220 and second fixture 222. The raised central portion 230 has a first shoulder 214 and a second shoulder 216. The first shoulder 214 is adapted to be in physical contact with the interior 221 of the first fixture 220 and the second shoulder 216 is adapted to be in physical contact with the interior 223 of the second fixture 222. The first 220 and second shoulder 222 provide a set of compressing forces F on the shoulders 214 and 216 of the raised central portion 230 of the ceramic core 202.

The ceramic core 202 of the apparatus 200 differs from the core 102 of the apparatus 100 shown in FIG. 1 in the angle 218 of the first shoulder 214 and second shoulder 216 relative to the body 201 the ceramic core 202. The angle 218 for the first shoulder 214 and second shoulder 216 is 90 degrees at a right angle from the body 201 of the ceramic core 202. This configuration creates only axial compressive forces when compressed by compressive force F by the first fixture 220 and second fixture 222. The compressive force F creates a hermetic seal about the raised central portion 230 at the abutment of the first shoulder 214 and second shoulder 216 with the interior 221 of the first fixture 220 and the interior 223 of the second fixture 222. The first end 212 and second end 210 of the ceramic core 202 may protrude beyond the fixtures 220 and 222.

Figure 3:
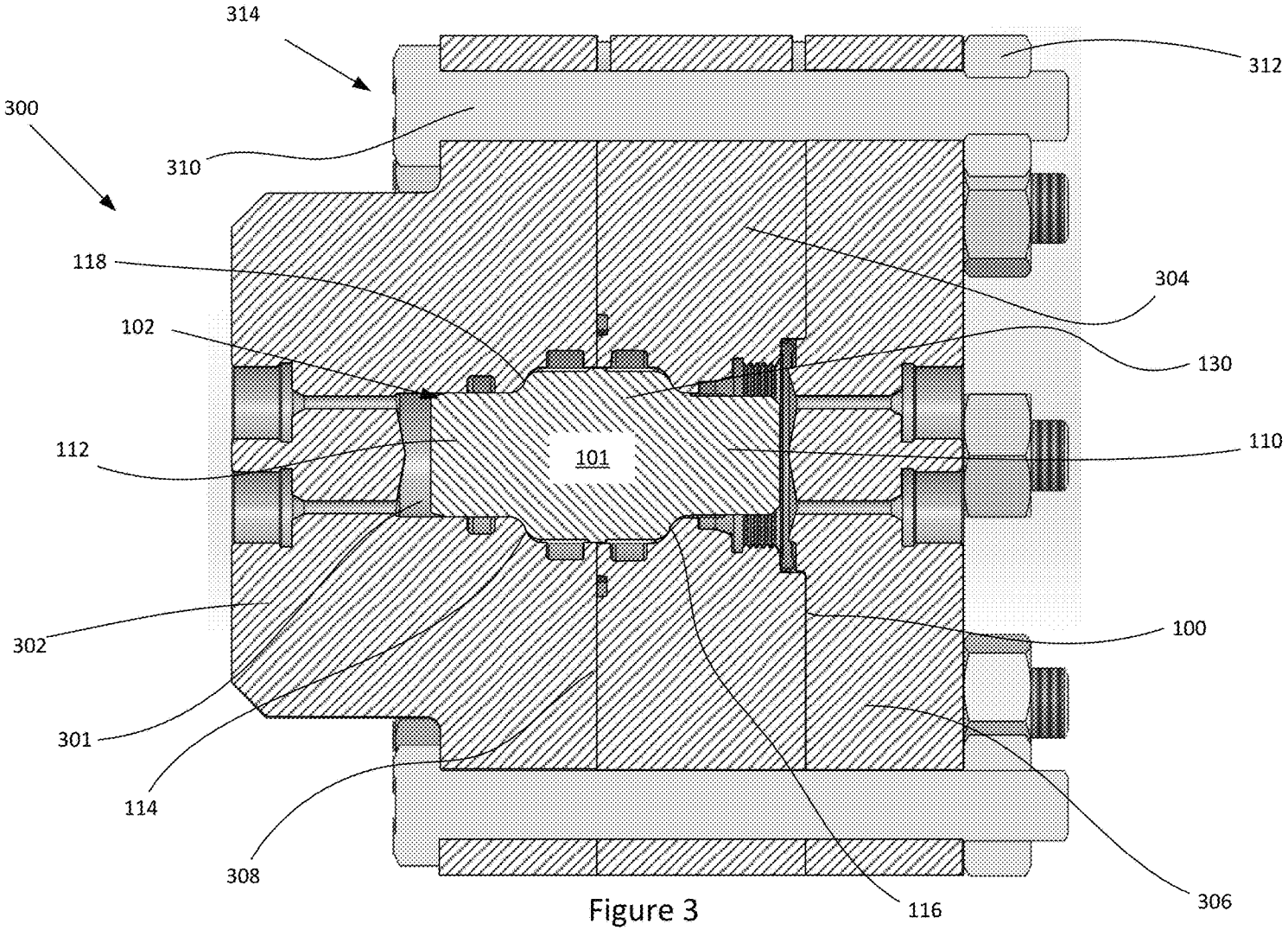
FIG. 3 provides a cross-section of a ceramic core in a sealing apparatus compressed between a set of test fixtures in accordance with the first embodiment of the present invention.

With reference now to FIG. 3, a cross-section of a ceramic core 102 in a sealing apparatus 300 compressed between a set of fixtures 302, 304, and 306 in accordance with the present invention is provided. The body 101 of the ceramic core 102 is disposed within the interior 301 of the first 302 and second 304 fixtures of the sealing apparatus 300. The first fixture 302 and second fixture 304 are in direct physical contact with the first shoulder 114 and second shoulder 116 of the raised central portion 130 respectively. Compressive force is applied by a set of nuts and bolts 314 compressing the exterior of the first fixture 302 and third fixture 306. The set of nuts and bolts 314 may apply a total of 96,000 lbs of compressive force on the apparatus 300. Each nut 312 and bolt 310 in the set of nuts and bolts 314 may be tightened to apply a 12,000 lb clamping force on the apparatus 300 which in turn applies axial and radial compressive forces on the ceramic core 102. In this configuration, wherein the angle 118 at the shoulders 114 and 116 is greater than 0 but less than 90, the compressing force applied by the set of nuts and bolts 314 applies both radial and axial compressing forces on the shoulders 114 and 116. This compressing force about the shoulders 114 and 116 of the raised central portion 130 creates a ceramic-to-metal seal between the shoulders 114 and 116 and the first fixture 302 and second fixture 304. The third fixture 306 applies the compressing force to the second fixture 304 by way of the set of nuts and bolts 314. In some configurations only the first fixture 302 and second fixture 304 may be present or required to form a hermetic seal about the ceramic core 102. The sealing apparatus 300 in the embodiment shown in FIG. 3 is a testing apparatus used to qualify the seal formed about the ceramic core 102 by the first fixture 302 and second fixture 304. However, the same or similar configuration may be employed to create a hermetic seal about a ceramic core similar to the ceramic core 102 shown in FIG. 3 without the exact first fixture 302 and second fixture 304 shown in the apparatus 300. To form the hermetic seal about the ceramic core 102 an angled geometry of the shoulders 114 and 116 and the first fixture 302 and second fixture 304 is required along with a high compressive force.

Figure 4:
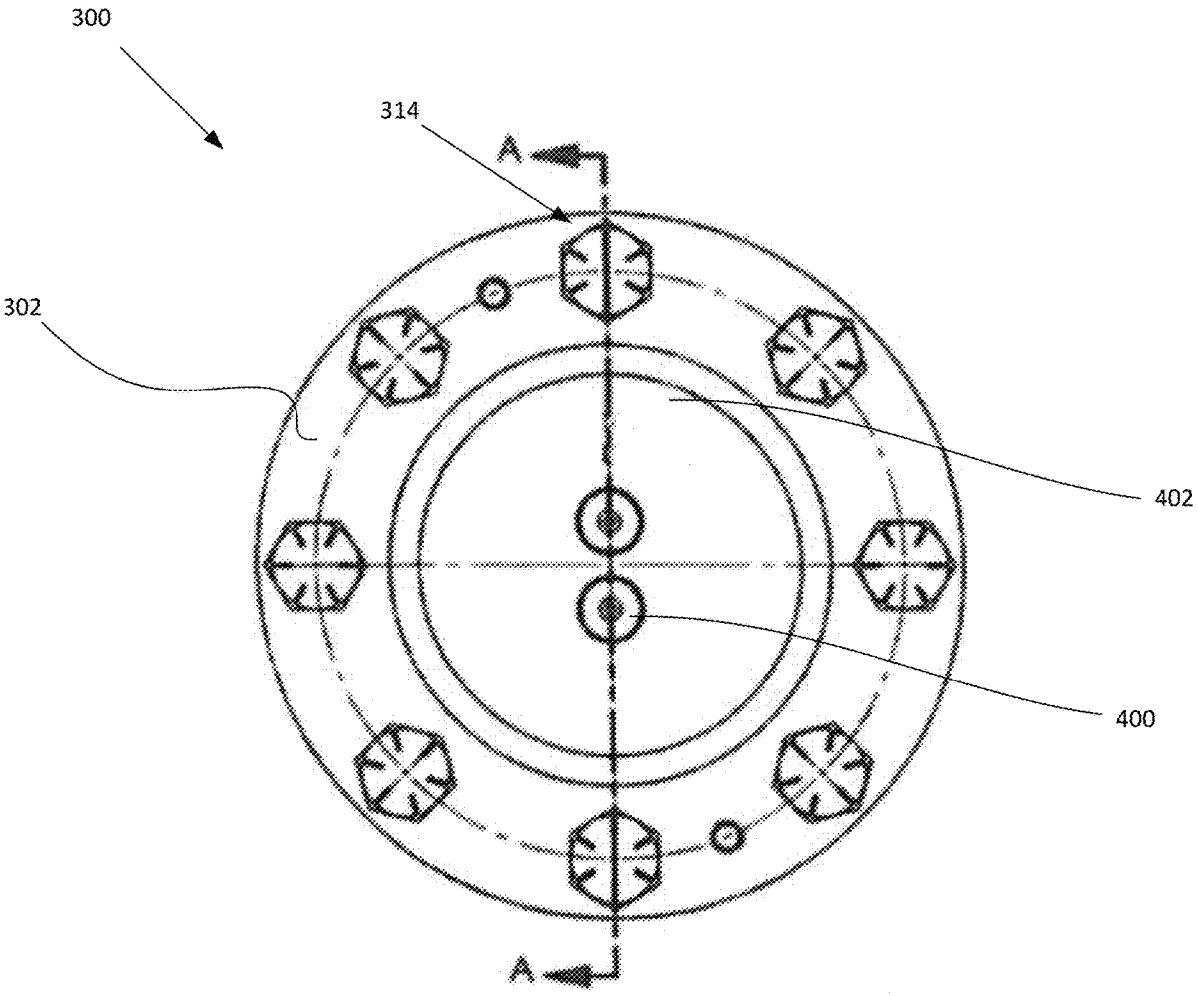
FIG. 4 provides a plan view of the exterior of a first end of an exemplary sealing apparatus having a set of eight nuts and bolts in accordance with the first embodiment of the present invention.

With reference to FIG. 4, a plan view of the exterior of a first end 402 of the sealing apparatus 300 in accordance with the present invention is provided. The cross-section shown in FIG. 3 is a cross-section at the axis A shown in FIG. 4. The set of nuts and bolts 314 is shown at the exterior of the first fixture 302 of the apparatus 300. The set of nuts and bolts 314 are not required to create the hermetic seal about the ceramic core 102 as shown in FIG. 3, however, a similar compressing force must be constantly applied to form the hermetic seal about the ceramic core 102. A set of ports 400 may be disposed on the exterior of the apparatus 300 to provide for pressurizing or depressurizing the apparatus or for measuring conditions within the apparatus 300.

Figure 5:
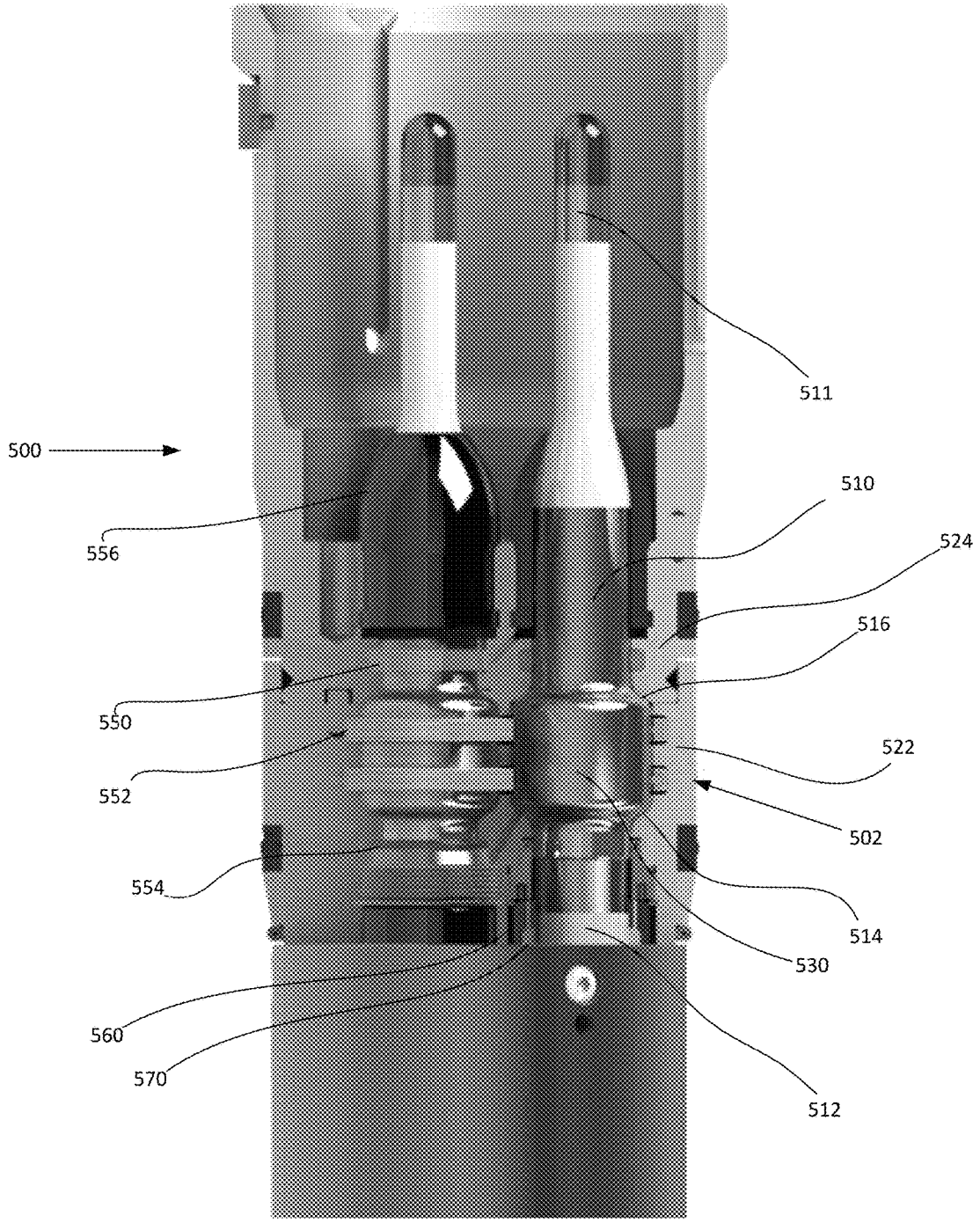
FIG. 5 provides a partial cross-section view of a dry-mate plug having a set of ceramic penetrators sealed in accordance with the first embodiment of the present invention.

With reference now to FIG. 5, a partial cross-section view of a dry-mate plug 500 having a set of ceramic penetrators 502 sealed in accordance with the first embodiment of the present invention is provided. The embodiment shown in FIG. 5 depicts an application for the ceramic-to-metal seal of the claimed invention as used in a dry-mate plug 500. The ceramic penetrator 502 may comprise an assembly as described in U.S. patent application Ser. No. 14/979,269, and U.S. patent application Ser. No. 14/979,296, which are incorporated herein by reference in their entirety. The ceramic penetrator 502 disposed within the dry-mate plug 500 forms a pressure barrier between exterior conditions and the interior 560 of the plug 500 and has a metallic sleeve 510. A set of cable pigtails are terminated at a pigtail end (not shown) of the conductor 511 at the first end 512 of ceramic penetrator 502, and may also be covered by an insulating boot 570. The first shoulder 514 and second shoulder 516 of the raised central portion 530 are angled at an angle of less than 90 but greater than 0 degrees and abut the interior of the first fixture 522 and second fixture 524. A compressive force applied by the first fixture 522 and second fixture 524 on the first shoulder 514 and second shoulder 516 forms a hermetic seal. The seal formed by the compressive forces may be supplemented by a set of rubberized or metal seals 550, 552, and 554 and by a sealing boot 556. The additional sealing elements 550, 552, 554 and sealing boot 556 are not required to form a hermetic seal about the ceramic penetrator 502.

While the invention has been described by reference to certain preferred embodiments, it should be understood that numerous changes could be made within the spirit and scope of the inventive concept described. In implementation, the inventive concepts may be automatically or semi-automatically, i.e., with some degree of human intervention, performed. Also, the present invention is not to be limited in scope by the specific embodiments described herein. It is fully contemplated that other various embodiments of and modifications to the present invention, in addition to those described herein, will become apparent to those of ordinary skill in the art from the foregoing description and accompanying drawings. Thus, such other embodiments and modifications are intended to fall within the scope of the following appended claims. Further, although the present invention has been described herein in the context of particular embodiments and implementations and applications and in particular environments, those of ordinary skill in the art will appreciate that its usefulness is not limited thereto and that the present invention can be beneficially applied in any number of ways and environments for any number of purposes. Accordingly, the claims set forth below should be construed in view of the full breadth and spirit of the present invention as disclosed herein.

What is claimed is:

1. A sealing apparatus for use in subsea environments exposed to differential pressure conditions, the apparatus comprising:

a central element having a first end, second end and a raised central portion, each of the first end, the second end, and the raised central portion being substantially cylindrical, and the raised central portion being ceramic and having first and second shoulders;

a first fixture having an opening with a metallic seal surface, the metallic seal surface of the opening abutting the first shoulder of the central element;

a second fixture having an opening with a metallic seal surface, the metallic seal surface of the opening abutting the second shoulder of the central element; and a means for fastening the first and second fixtures about the central element, wherein the fastening means applies a set of forces to the first and second fixtures and forms a seal about the raised central portion of the central element by urging the respective metallic seal surfaces into engagement with the respective first and second shoulders of the raised central portion, the set of forces are collectively a clamping force of at least 90,000 pounds.

2. The apparatus of claim 1, further comprising a third fixture, the third fixture having a first side and a second side and being disposed at a second side of the second fixture.

3. The apparatus of claim 2, further comprising:

the first fixture further abutting the first side of the third fixture; and the second fixture further abutting the second side of the third fixture;

wherein the set of forces applied to the first and second fixtures compress said first and second fixtures to the respective first and second shoulders of the central element and the first side and second side of the third fixture.

4. The apparatus of claim 1, wherein the central element comprises a metallic sleeve disposed about the raised central portion.

5. The apparatus of claim 1, wherein the clamping force is 96,000 pounds.

6. The apparatus of claim 1, wherein the means for applying the set of forces comprises a set of nut and bolt pairs.

7. The apparatus of claim 6, wherein each nut and bolt pair in the set of nut and bolt pairs applies a 12,000 pound clamping force.

8. The apparatus of claim 1, wherein the first and second shoulders are angled from the central element at an angle of greater than 0° but less than 90° and the set of forces comprise both radial and axial compressive forces.

9. The apparatus of claim 1, wherein the first and second shoulders are angled from the central element at an angle of 90° and the set of forces are axial compressive forces.

10. The apparatus of claim 1, wherein the central element comprises a communications component having terminal ends that extend beyond the first and second fixtures.

* * * * *